US009099075B2

(12) United States Patent
Sekine et al.

(10) Patent No.: US 9,099,075 B2
(45) Date of Patent: Aug. 4, 2015

(54) STANDING WAVE ATTENUATION DEVICE

(75) Inventors: Satoshi Sekine, Hamamatsu (JP); Rento Tanase, Iwata (JP); Keiichi Fukatsu, Hamamatsu (JP); Shinichi Kato, Hamamatsu (JP); Atsushi Yoshida, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 798 days.

(21) Appl. No.: 13/275,247

(22) Filed: Oct. 17, 2011

(65) Prior Publication Data

US 2012/0097477 A1 Apr. 26, 2012

(30) Foreign Application Priority Data

Oct. 20, 2010 (JP) ..... 2010-235833
Sep. 9, 2011 (JP) ..... 2011-196777

(51) Int. Cl.

| | |
|---|---|
| ***G10K 11/16*** | (2006.01) |
| ***G10K 11/178*** | (2006.01) |
| *H04S 7/00* | (2006.01) |
| *H04R 3/04* | (2006.01) |

(52) U.S. Cl.

CPC ..... *G10K 11/178* (2013.01); *H04R 3/04* (2013.01); *H04S 7/305* (2013.01)

(58) Field of Classification Search

CPC ..... H04R 3/04; H04S 7/305; G10K 11/178
See application file for complete search history.

(56) References Cited

U.S. PATENT DOCUMENTS

| | | | | |
|---|---|---|---|---|
| 4,130,727 | A * | 12/1978 | Kates | 381/98 |
| 4,980,914 | A * | 12/1990 | Kunugi et al. | 381/1 |
| 6,940,983 | B2 | 9/2005 | Stuart | |
| 2008/0285768 | A1 * | 11/2008 | Larsen et al. | 381/73.1 |
| 2008/0298604 | A1 * | 12/2008 | Starobin et al. | 381/73.1 |

FOREIGN PATENT DOCUMENTS

| | | | |
|---|---|---|---|
| CN | 101031222 | A | 9/2007 |
| CN | 201347822 | Y | 11/2009 |
| JP | 2009-220775 | | 10/2009 |
| WO | WO-99/10608 | A1 | 3/1999 |

OTHER PUBLICATIONS

Chinese Office Action issued for Application No. CN 201110319083.7, date of issuing Oct. 10, 2013 (with English translation attached).

* cited by examiner

*Primary Examiner* — Joseph Saunders, Jr.
(74) *Attorney, Agent, or Firm* — Dickstein Shapiro LLP

(57) ABSTRACT

A standing wave attenuation device is installed in a cabin of a vehicle so as to reduce a standing wave caused by external noise such as road noise. The standing wave attenuation device provides a closed loop including a feedback comb filter with a feedback loop, a microphone, a speaker, and a delay element. The delay element adjusts the phase of the output signal of the feedback comb filter such that the time needed for one-time circulation of a signal through the feedback loop matches a half period of the standing wave. An original sound including the standing wave is picked up by the microphone and subjected to processing so that the speaker produces a sound wave with the inverse phase against the phase of a sound wave constituting the standing wave, so that the standing wave is canceled out by the sound wave emitted from the speaker.

4 Claims, 10 Drawing Sheets

STANDING WAVE ATTENUATION DEVICE

BACKGROUND OF THE INVENTION

1. Field of the Invention

The present invention relates to sound damping devices that dampen noise in running vehicles, and in particular to standing wave attenuation devices that attenuate standing waves in cabins or rooms of vehicles.

The present application claims priority on Japanese Patent Application Nos. 2010-235833 and 2011-196777, the entire content of which is incorporated herein by reference.

2. Description of the Related Art

In general, vehicles suffer from vibrations of the wheels while running, which are transmitted into cabins or rooms of vehicles, thus causing noise with a broad range of frequency components. This noise is called road noise, which is transmitted into cabins or rooms of vehicles to cause standing waves offensive to human cars. Patent Document 1 discloses a technology for attenuating standing waves in cabins or rooms of vehicles. Patent Document 1 discloses in conjunction with its FIGS. 15 to 18 that a plurality of pipes, each having a quarter length of each standing wave, is fixed to the interior surface of a roof inside a cabin of a vehicle. When standing waves whose frequencies match the resonance frequencies of pipes occur in a cabin of a vehicle, a pipe resonating phenomenon occurs in pipes so as to cancel out energy of standing waves. Thus, this technology is able to attenuate standing waves in a cabin of a vehicle.

The technology of Patent Document 1 needs to determine lengths of pipes, which are sufficient to attenuate standing waves in cabins of vehicles, based on dimensions of cabins in advance, whereby these pipes are fixed under roofs of vehicles. Vehicles such as four-door sedans, for example, provide cabins whose shapes may easily cause standing waves with frequencies around 160 Hz. Long pipes whose lengths are 50 cm or more should be prepared to attenuate standing waves at 160 Hz by way of the pipe resonating phenomenon. However, it is difficult to install long pipes inside cabins of vehicles. Even if long pipes are successfully installed in cabins, they may give a sense of oppression to drivers or passengers in vehicles. When vehicles undergo fluctuations in vibration directions and frequencies due to age degradation in excitation conditions such as air pressures applied to tires of wheels, it is difficult to adapt to fluctuating vibration conditions by way of resonance frequencies of pipes; hence, it becomes difficult to attenuate standing waves in cabins over a lapse of time.

PRIOR ART DOCUMENT

Patent Document 1: Japanese Patent Application Publication No. 2009-220775

SUMMARY OF THE INVENTION

It is an object of the present invention to provide a standing wave attenuation device which is able to attenuate standing waves in a limited space without occupying it.

A standing wave attenuation device of the present invention includes a first closed loop including an acoustic vibration input device which converts sound, including a standing wave component picked up by a microphone, into a sound signal, a feedback comb filter which processes the sound signal to pass the standing wave component therethrough, and an acoustic vibration output device which provides an output signal based on the processing result of the feedback comb filter; a first phase adjustment part, involved in the first closed loop, which adjusts a phase difference, between an input phase of the standing wave component input to the acoustic vibration input device and an output phase of the standing wave component output from the acoustic vibration output device, to match an odd-numbered multiple of a prescribed value relating to a period of the standing wave component; a second closed loop involving the feedback comb filter with an adder which introduces the output signal of the acoustic vibration input device into the second closed loop; and a second phase adjustment part, involved in the second closed loop, which adjusts a phase difference, between a phase of the standing wave component input to the adder via the acoustic vibration input device and a phase of the standing wave component fed back to the adder via the second closed loop, to match an odd-numbered multiple of the prescribed value. The prescribed value may correspond to a half period of the standing wave component, so that the delay element adjusts the phase of the feedback comb filter such that the time needed for one-time circulation of a signal through the second closed loop matches the half period of the standing wave component.

The standing wave attenuation device may be installed in a cabin of a vehicle so as to reduce noise such as road noise. When a standing wave occurs in the cabin of a vehicle, the acoustic vibration input device provides a sound signal including a standing wave component, which is transmitted through the feedback comb filter and the delay element, so that the acoustic vibration output device emits a sound wave with an inverse phase against the phase of a sound wave constituting the standing wave. The sound wave of the standing wave is canceled out by the sound wave of the acoustic vibration output device, so that the standing wave is reduced. The standing wave attenuation device needs a relatively small space for installation but demonstrates a high attenuation effect on the standing wave which may be offensive to human ears.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENTS

The present invention will be described in further detail by way of examples with reference to the accompanying drawings.

1. First Embodiment

Figure 1A:
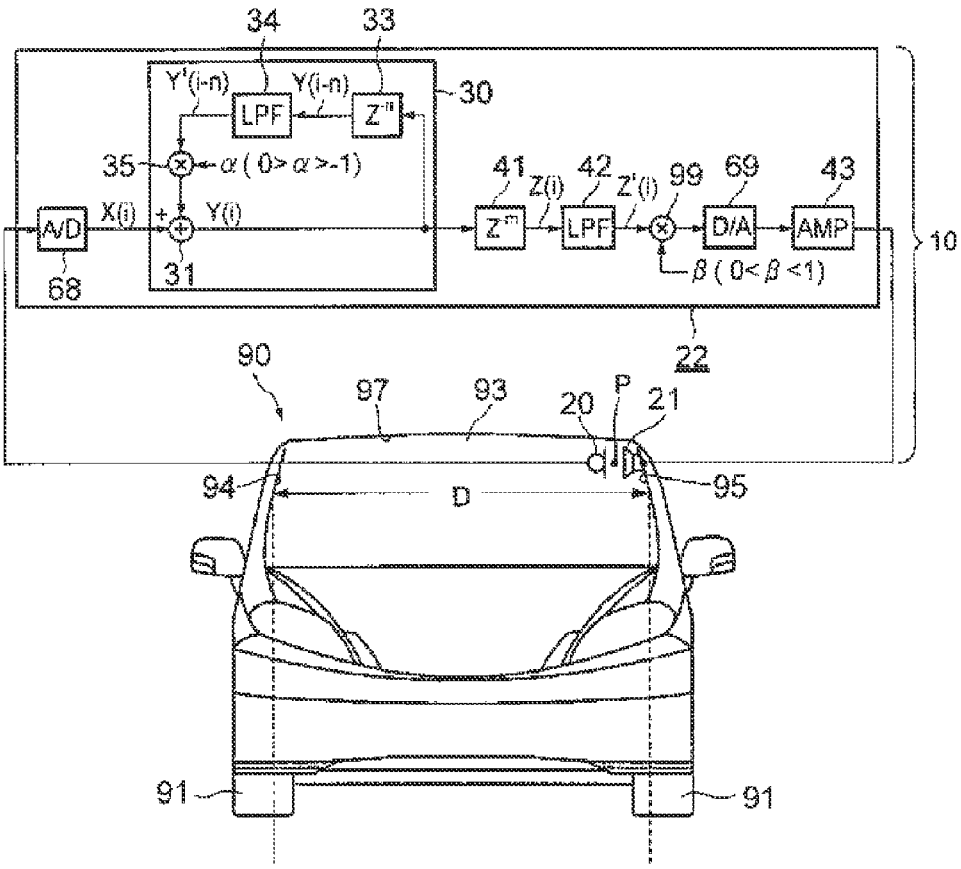
FIG. 1A shows the constitution of a standing wave attenuation device installed in a vehicle according to a first embodiment.
Figure 1B:
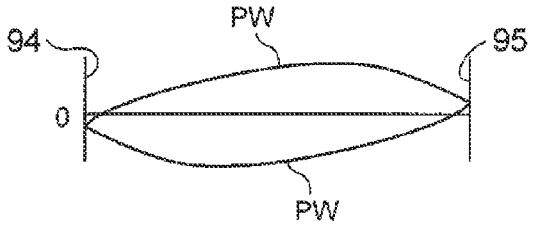
FIG. 1B shows sound waves PW which occur between doors of a vehicle.
Figure 1C:
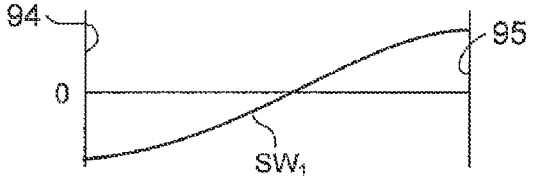
FIG. 1C shows a standing wave $SW_1$ which is formed by mixing sound waves PW.

FIG. 1A shows the constitution of a standing wave attenuation device 10 installed in a vehicle 90. When tires 91 of the vehicle 90 cause a vibration which is transmitted to a cabin 93 with its natural frequency, a plurality of sound waves PW (e.g. two sound waves PW in FIG. [[1A]] 1B) reflects on two opposite sides (i.e. a door 94 of a driver's seat and a door 95 of another front passenger's seat) in the cabin 93, wherein sound waves PW (see FIG. 1B) are mixed to form a standing wave SWk (see FIG. 1C) with a single frequency (i.e. a k-degree acoustic mode), which is equivalent to a wavelength which is 2/k (where k=1, 2, . . . ) times longer than a distance D between the doors 94 and 95.

A control point P is set to the upper portion of the door 95 which is disposed in connection with an antinode of the k-degree standing wave $SW_k$ inside the cabin 93. The standing wave attenuation device 10 emits a sound wave CW (not shown) which cancels out the sound waves PW, constituting the standing wave $SW_k$, at the control point P, thus attenuating (or eliminating) the standing wave $SW_k$.

The standing wave attenuation device 10 provides a closed loop $LP_{OUT}$ including a microphone 20, a controller 22, and a speaker 21. The microphone 20 of the closed loop $LP_{OUT}$ serves as an acoustic vibration input device which absorbs and converts sound, including components of the standing wave $SW_k$ subjected to attenuation, into electric signals. The speaker 21 serves as an acoustic vibration output device which outputs sound based on electric signals processed by the controller 22. The speaker 21 is fixed to the upper portion of the door 95, in proximity to an assist grip (not shown) accommodated for another front passenger's seat, such that its sound-emitting face directs toward the control point P. The microphone 20 is fixed to a position, close to the upper portion of the door 95, in the same plane as the speaker 21.

The controller 22 generates a sound signal Z'(i), corresponding to the sound wave CW, based on a sound signal X(i) which is input to the controller 22 from the microphone 20, so that the speaker 21 produces sound, corresponding to the sound wave CW, based on the sound signal Z'(i). The controller 22 includes an A/D converter 68, a feedback comb filter 30, a delay element 41, a low-pass filter (LPF) 42, a D/A converter 69, and a power amplifier (AMP) 43.

The A/D converter 68 converts an analog signal, output from the microphone 20, into a digital signal, which is forwarded to the feedback comb filter 30 as the sound signal X(i). The feedback comb filter 30 has a closed loop $LP_{IN}$ including an adder 31, a delay element 33, an LPF 34, and a coefficient multiplier 35. The adder 31 of the closed loop $LP_{IN}$ returns an output signal Y(i) of the feedback comb filter 30 to the closed loop $LP_{IN}$. The delay element 33 serves as a phase adjustment part which produces an odd-numbered multiple of a phase difference (which is an odd-numbered multiple of n), between an input phase of a frequency component of the standing wave SW1, included in the sound signal X(i) which is input to the adder 31 from the microphone 20 via the A/D converter 68, and a feedback phase of the same frequency component, included in a feedback signal to the adder 31 via the closed loop $LP_{IN}$. The LPF 34 serves as a frequency characteristic adjustment part, which adjusts frequency characteristics of the feedback signal to the adder 31 via the closed loop $LP_{IN}$. The coefficient multiplier 35 serves as a feedback gain adjustment part which inverts the phase of the feedback signal already adjusted in frequency characteristics.

Specifically, the adder 31 of the closed loop $LP_{IN}$ adds the output signal $Y'(i-n)\times\alpha$ of the coefficient multiplier 35 (where a denotes a coefficient) to the sound signal X(i) of the A/D converter 68 so as to produce an addition signal $X(0+Y'(i-n)\times\alpha$, which is forwarded to the delay element 41 and the delay element 33 of the feedback comb filter 30 as an output signal Y(i). The delay element 33 delays the output signal Y(i) by n samples so as to output a signal Y(i−n) to the LPF 34. Herein, the delay element 33 possesses a delay time $DT_{33}$ corresponding to an odd-numbered multiple of a half period of the standing wave $SW_k$ (i.e. $T_1/2$). The number of samples used for delaying the output signal Y(i) in the delay element 33 is produced by dividing the delay time $DT_{33}$ by the sampling period Ts of the sound signal X(i). The LPF 34 dampens frequency components lower than a cutoff frequency fc within the output signal Y(i−n) of the delay element 33, thus outputting a signal Y'(i−n) to the coefficient multiplier 35. The cutoff frequency fc of the LPF 34 is higher than a frequency $f_{SW1}$ of the standing wave $SW_1$ but lower than a frequency $f_{SW2}$ of the standing wave $SW_2$, wherein $f_{SWk}=c/\lambda_k$ where c denotes speed of sound (m/s). The coefficient multiplier 35 multiplies the output signal Y'(i−n) of the LPF 34 by a negative coefficient α (where $0>\alpha>-1$), thus outputting the signal $Y'(i-n)\times\alpha$ to the adder 31.

A time needed for one-time circulation of a signal through the closed loop $LP_{IN}$ including the adder 31, the delay element 33, the LPF 34, and the coefficient multiplier 35 is about a half period (i.e. $T_1/2$) of the standing wave SW1 with the longest wavelength among standing waves $SW_k$ subjected to attenuation, wherein it is noted that the coefficient multiplier 35 performing phase inversion is included in the closed loop $LP_{IN}$. Paying attention to the same frequency component as the standing wave $SW_1$, the adder 31 adds the component of the standing wave SW1, included in the sound signal X(i) input via the A/D converter 68, and the component of the standing wave SW1, included in the feedback signal Y'(i−n)×α via the coefficient multiplier 35, with respect to the same phase. Therefore, the feedback comb filter 30 selectively passes the component of the standing wave SW1, within the sound signal X(i) input via the A/D converter 68, to propagate therethrough.

The delay element 41, following the feedback comb filter 30, serves as a phase adjustment part which converts a phase difference, between an input phase of the standing wave $SW_k$ input to the microphone 20 and an output phase of the standing wave $SW_k$ output from the speaker 21, into an odd-numbered multiple of π. The delay element 41 delays the output signal Y(i) of the feedback comb filter 30 by m samples, thus outputting a signal Z(i) to an LPF 42. In a closed loop $LP_{OUT}$, transmission delays occur in the speaker 21, an air conductive path between the speaker 21 and the microphone 20, the microphone 20, the A/D converter 68, the feedback comb filter 30, and the delay element 41 as well as the LPF 42, a coefficient multiplier 99, a D/A converter 69, and a power amplifier 43 respectively. The delay element 41 possesses a delay time $DT_{41}$ corresponding to a difference between the total of transmission delays, included in the closed loop $LP_{OUT}$, and an odd-numbered multiple of a half period ($T_1/2$) of the standing wave $SW_1$. The number m of samples used for delaying the output signal Y(i) in the delay element 41 is produced by dividing the delay time $DT_{41}$ by the sampling period Ts of the sound signal X(i).

The LPF 42 serves as a frequency characteristic adjustment part which adjusts frequency characteristics of the feedback signal that is fed back to the control point P via the closed loop $LP_{OUT}$. The LPF 42 dampens frequency components higher than the cutoff frequency fc (which is higher than $f_{SW1}$ but lower than $f_{SW2}$) within the output signal Z(i) of the delay element 41, thus outputting a signal Z'(i) to the coefficient multiplier 99. The coefficient multiplier 99 multiplies the output signal Z'(i) by a positive coefficient β (where 0<β<1), thus outputting its multiplication result Z'(i)×β to the D/A converter 69. This signal Z'(i)×β is converted into an analog signal by the D/A converter 69 and then amplified by the power amplifier 43, so that the speaker 21 outputs the sound wave CW.

When the standing wave $SW_k$ is excited in the cabin 93 while the standing wave attenuation device 10 is in operation, the speaker 21 emits the sound wave CW, which includes a frequency component identical to a single frequency of the standing wave $SW_k$ and which has an inverse phase against the phase of the sound wave SW constituting the standing wave $SW_k$, toward the control point P. The details of this process will be described below.

Figure 2:
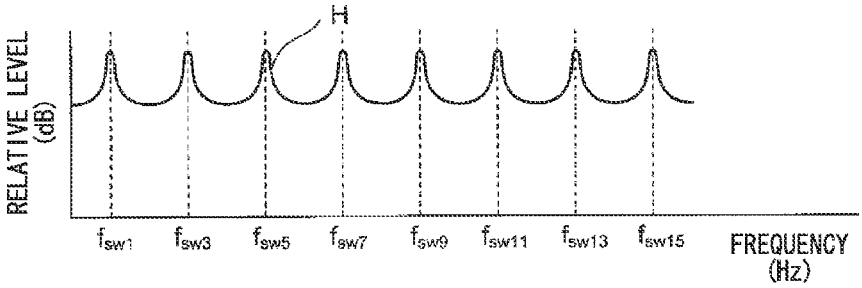
FIG. 2 shows amplitude characteristics H specified by a basic configuration of a feedback comb filter.

FIG. 2 shows amplitude characteristics H specified by a basic configuration of a feedback comb filter (corresponding to the constitution of the feedback comb filter 30 precluding the LPF 34 in FIG. 1). In the case of α<0, the amplitude characteristics H indicate peaks (or extremes) at the frequency $f_{SW1}$ of the standing wave SW1 and its odd-numbered multiples. This is because the feedback comb filter 30 involves a phase difference (corresponding to an odd-numbered multiple of π) between the input phase of the standing wave $SW_1$ input to the adder 31 via the A/D converter 68 and the feedback phase of the standing wave $SW_1$ fed back to the adder 31 via the coefficient multiplier 35 in the closed loop $LP_{IN}$, wherein the adder 31 adds the feedback component of the standing wave $SW_1$ (from the coefficient multiplier 35) to the input component of the standing wave $SW_1$ (from the A/D converter 68) with respect to the same phase. Additionally, the standing wave attenuation device 10 involves a phase difference (corresponding to an odd-numbered multiple of π) between the input phase of the standing wave $SW_k$ input to the microphone 20 and the output phase of the standing wave $SW_k$ output from the speaker 21. For this reason, when the first-degree standing wave SW1 is excited in the cabin 93, a sound wave (see FIG. 4) with a single frequency corresponding to the frequency $f_{SW1}$ of the standing wave $SW_1$ is output as the sound wave CW with the inverse phase against the phase of the sound wave PW constituting the standing wave $SW_1$.

The first embodiment demonstrates the following effects.

(1) When the standing wave $SW_k$ is excited in the cabin 93, the sound signal X(i) at the control point P is transmitted through the A/D converter 68, the feedback comb filter 30, the delay element 41, the LPF 42, the coefficient multiplier 99, the D/A converter 69, and the power amplifier 43 so that the sound wave CW with the inverse phase against the phase of the sound wave PW constituting the standing wave $SW_k$ is fed back to the control point P. At the control point P, the sound waves PW and CW cancel out each other, thus attenuating the standing wave $SW_k$. Even when the sound signal X(i) includes audio components (e.g. audio components produced by an audio device) other than the standing wave $SW_k$, audio components are attenuated by the feedback comb filter 30 and not fed back to the cabin 93. For this reason, it is possible to prevent howling caused by circulation of audio signals (produced by an audio device) through the closed loop $LP_{OUT}$, so that the standing wave attenuation device 10 will not cause a negative impact on audio quality. That is, the first embodiment is able to efficiently attenuate the standing wave SWk without causing howling and without causing a negative impact on audio quality in the cabin 93 of the vehicle 90.

(2) The first embodiment interposes the LPFs 34 and 42, following the delay elements 33 and 41, thus attenuating high-frequency components within the signal Z'(i). When the frequency of the standing wave $SW_1$ increases so that the total delay time becomes higher than the half period ($T_1/2$) of the standing wave $SW_1$, it is possible to delay the signal Y(i) by one period ($T_1$) of the standing wave $SW_1$ and then invert its phase, thus producing the signal Z'(i). Using analog delay elements and analog filters, it is possible to reconfigure the standing wave attenuation device by use of analog circuits alone.

The first embodiment interposes the coefficient multiplier 99 between the LPF 42 and the D/A converter 69, wherein the amplitude of the sound wave CW increases as the coefficient p of the coefficient multiplier 99 becomes close to "1" whilst the amplitude of the sound wave CW decreases as the coefficient β becomes close to "0". By appropriately setting the coefficient β, it is possible to prevent howling caused by circulation of the sound wave CW through the closed loop $LP_{OUT}$.

Figure 4:
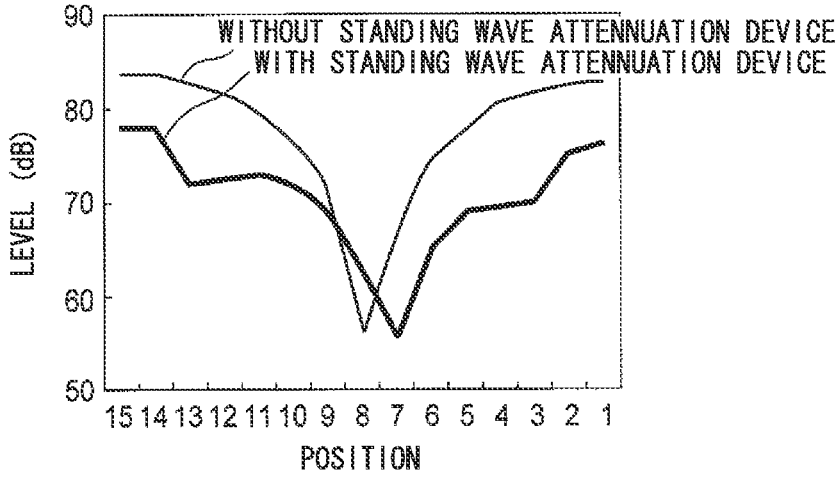
FIG. 4 shows measurement results with respect to sound pressure levels measured at various points between the door of a driver's seat and the door of another front passenger's seat in a vehicle.

The present inventors have conducted experiments to verify the effect of the standing wave attenuation device 10. In the experiments, the standing wave attenuation device 10 is installed in a four-door sedan vehicle, wherein a sound wave with the frequency $f_{SW1}$ is emitted inside a cabin so as to measure sound pressures at the prescribed points between a door of a driver's seat and a door of another front passenger's seat. FIG. 4 is a graph of measurement results illustrating two curves representing sound pressure distributions with respect to a first sample with the standing wave attenuation device 10 installed in a vehicle and a second sample without the standing wave attenuation device 10, wherein the vertical axis represents sound energy (i.e. sound pressure levels) whilst the horizontal axis represents the distance measured from the door of another front passenger's seat toward the door of the driver's seat. FIG. 4 shows that the sound pressure level increases at the points close to the doors in both the first and second situations (with/without the standing wave attenuation device 10). This indicates that a first-degree standing wave SW1 (with the wavelength two times longer than the distance between the doors) occurs in the cabin of a vehicle. Compared with the second sample, the first sample with the standing wave attenuation device 10 clearly improves its noise resistance so that sound pressure levels decrease at the prescribed points.

Figure 5:
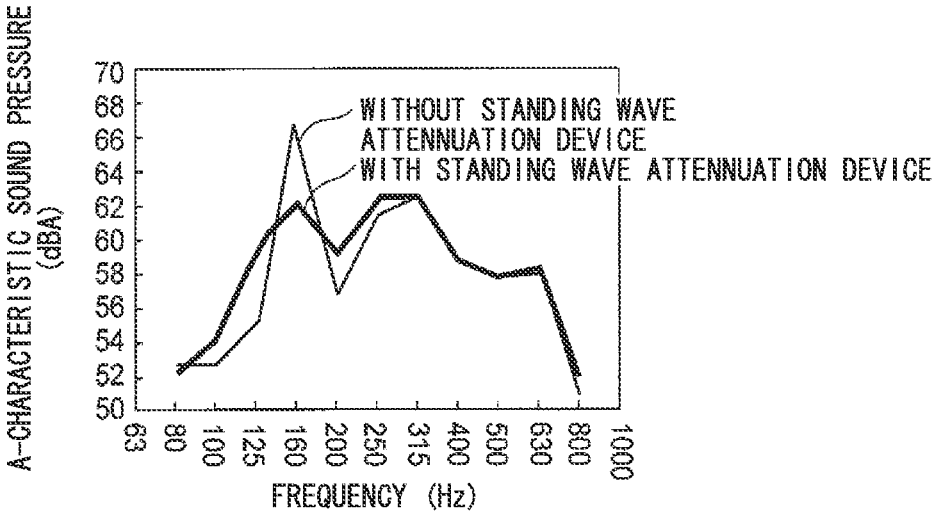
FIG. 5 shows other measurement results with respect to A-characteristic sound pressures measured at the headrest of a driver's seat in a vehicle.

The present inventors have conducted other experiments to measure a power spectrum at a measuring point close to the head rest of a driver's seat, wherein a test sound including a wide range of frequency components is emitted inside the cabin of a vehicle. The power spectrum is measured with respect to the first sample with the standing wave attenuation device 10 installed in a vehicle and the second sample without the standing wave attenuation device 10. FIG. 5 is a graph of measurement results, wherein A characteristics are calculated by amending amplitude characteristics of ⅓ octave based on human auditory characteristics. Generally speaking, the frequency $f_{SWk}$ of the standing wave $SW_k$ occurring inside a cabin of a vehicle depends upon the shape of the cabin. A four-door sedan vehicle undergoes a first-degree standing wave $SW_1$ with its frequency $f_{SW1}$ at about 160 Hz. The graph of FIG. 5 shows significant differences in A-characteristic sound pressures at 160 Hz between the first sample and the second sample (i.e. with/without the standing wave attenuation device 10). Specifically, the first sample (with the standing wave attenuation device 10) demonstrates 62 dB of A characteristic sound pressure at 160 Hz, whilst the second sample (without the standing wave attenuation device 10) demonstrates 67 dB of A characteristic sound pressure at 160 Hz.

The above results clearly prove that the standing wave SW1 can be significantly reduced by use of the standing wave attenuation device 10 installed in the cabin 93 of the vehicle 90.

2. Second Embodiment

Figure 6:
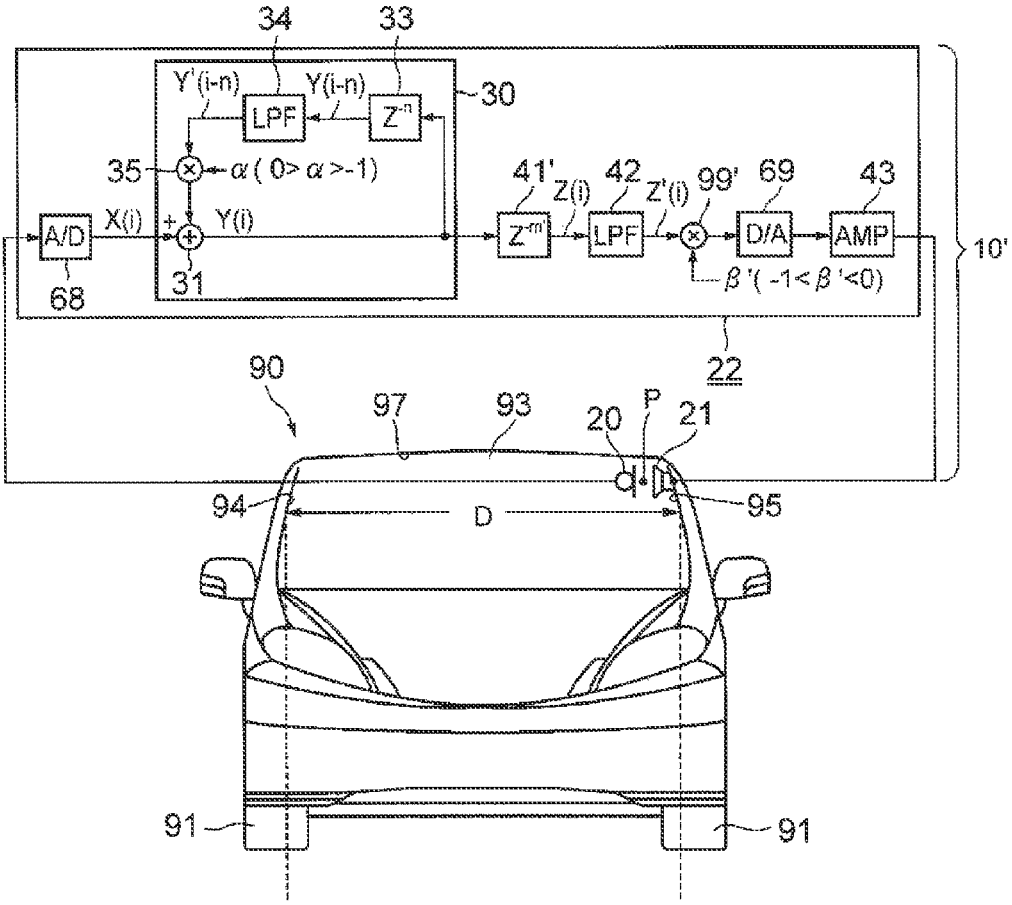
FIG. 6 shows the constitution of a standing wave attenuation device installed in the vehicle according to a second embodiment.

FIG. 6 shows the constitution of a standing wave attenuation device 10' installed in the vehicle 90 according to a second embodiment of the present invention. In the standing wave attenuation device 10', a delay element 41' and a coefficient multiplier 99' serving as a phase adjustment part are incorporated into the closed loop $LP_{OUT}$ whilst the delay element 33 and the coefficient multiplier 35 serving as another phase adjustment part are incorporated into the closed loop $LP_{IN}$.

Specifically, the standing wave attenuation device 10' includes the feedback comb filter 30 in which the adder 31 adds the sound signal X(i) from the A/D converter 68 and the output signal Y'(i−n) of the coefficient multiplier 35 so as to produce its addition result Y(i), which is forwarded to the delay element 41' and the delay element 33. The delay element 33 delays the output signal Y(i) of the adder 31 by n samples (i.e. the delay time $DT_{33}$) so as to output the signal Y(i−n) to the LPF 34. The LPF 34 dampens frequency components above the cutoff frequency fc within the output signal Y(i−n) of the delay element 33, thus outputting the signal Y'(i−n) to the coefficient multiplier 35. The coefficient multiplier 35 multiplies the output signal Y'(i−n) of the LPF 34 by the negative coefficient α (where 0>α>−1), thus outputting its multiplication result Y'(i−n)×α to the adder 31.

In the standing wave attenuation device 10', the delay element 41' delays the output signal Y(i) of the feedback comb filter 30 by m' samples so as to output the signal Z(i) to the LPF 42. The delay element 41' possesses a delay time $DT_{41'}$, corresponding to a difference between the total of delays in the closed loop $LP_{OUT}$ (i.e. transmission delays due to the speaker 21, the air conduction path between the speaker 21 and the microphone 20, the microphone 20, the A/D converter 68, the feedback comb filter 30, the delay element 41', the LPF 42, the coefficient multiplier 99', the D/A converter 69, and the power amplifier 43) and an integral multiple of the period $T_1$ of the standing wave $SW_1$. The number m' of samples used for delaying the signal Y(i) in the delay element 41' is produced by dividing the delay time $DT_{41'}$, by the sampling period Ts of the sound signal X(i). The coefficient multiplier 99' multiplies the output signal Z'(i) of the delay element 41' by a negative coefficient β' (where −1<β'<0) so as to invert the phase of the signal Z'(i). Thus, the coefficient multiplier 99' outputs the phase-inverted signal Z'(i)×β' to the D/A converter 69.

In the second embodiment, the standing wave attenuation device 10' feeds back the sound wave CW, with the inverse phase against the phase of the sound wave PW constituting the standing wave $SW_k$, to the control point P. Similar to the first embodiment, the second embodiment is able to reduce the standing wave $SW_k$ without causing howling and without causing a negative impact on audio quality in the cabin 93.

3. Third Embodiment

Figure 7:
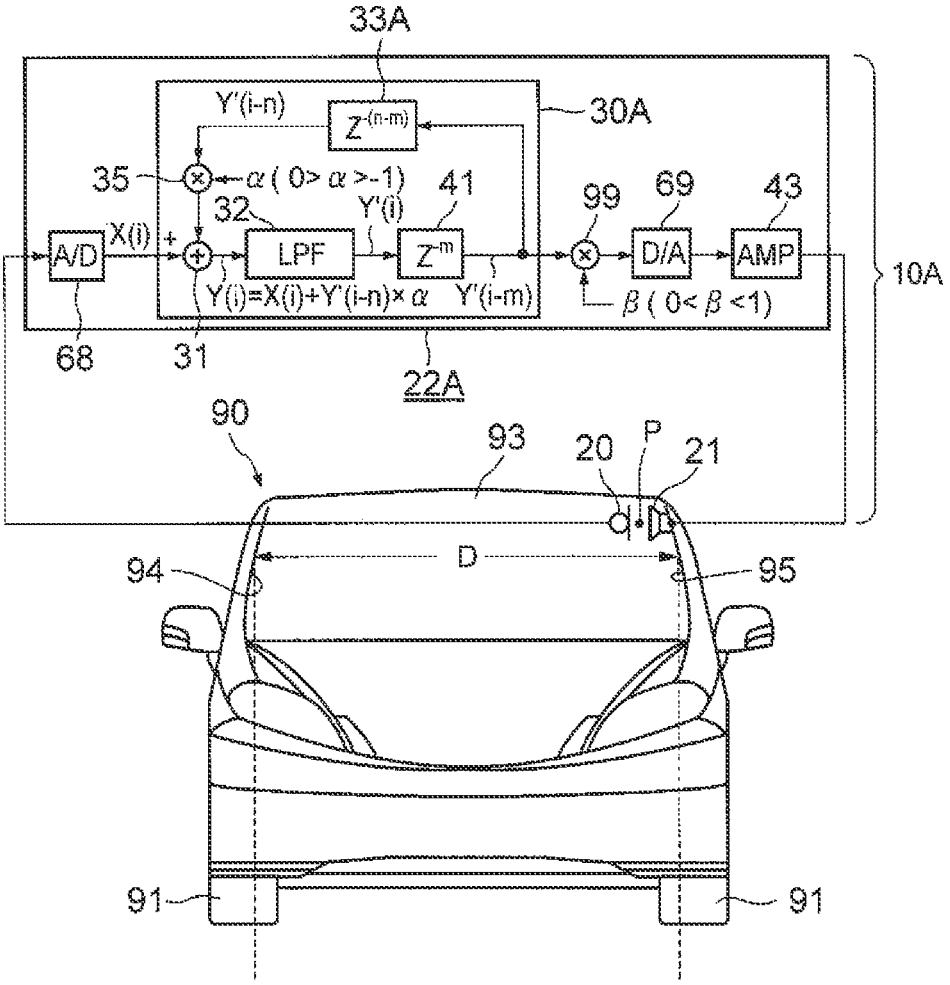
FIG. 7 shows the constitution of a standing wave attenuation device installed in the vehicle according to a third embodiment.

FIG. 7 shows the constitution of a standing wave attenuation device 10A installed in the vehicle 90. In the standing wave attenuation device 10A, the delay element 41 and the coefficient multiplier 99 serving as a phase adjustment part are incorporated into the closed loop $LP_{OUT}$ whilst a delay element 33A, the delay element 41, and the coefficient multiplier 35 serving as another phase adjustment part are incorporated into the closed loop $LP_{IN}$. Herein, the delay element 41 of the feedback comb filter 30 plays a role as a common factor between two phase adjustment parts.

Specifically, in the standing wave attenuation device 10A, a feedback comb filter 30A includes the adder 31, which adds the sound signal X(i) of the A/D converter 68 and the output signal Y'(i−n)×a of the coefficient multiplier 35 so as to outputs its addition result Y(i)=X(i)+Y'(i−n)×a to the LPF 32. The LPF 32 dampens frequency components above the cutoff frequency fc within the output signal Y(i) of the adder 31, thus outputting the signal Y'(i) to the delay element 41. The delay element 41 delays the output signal Y'(i) of LPF 32, by m samples (i.e. the delay time $DT_{41}$, thus outputting a signal Y'(i−m), which may include frequency components of the standing wave SWk in the sound signal X(i), to the coefficient multiplier 99 and the delay element 33A of the feedback comb filter 30A.

The delay element 33A delays the output signal Y'(i−m) of the delay element 41 by (n−m) samples so as to output a signal Y'(i−n) to the coefficient multiplier 35. Herein, the delay element 33A possesses a delay time $DT_{33A}$ corresponding to a difference between the delay time $DT_{41}$ of the delay element 41 and an odd-numbered multiple of the half period $T_1/2$ of the standing wave SW1. The number (n−m) of samples used for delaying the signal Y'(i−m) of the delay element 41 is produced by dividing the delay time $DT_{33A}$ of the delay element 33A by the sampling period Ts of the sound signal X(i). The coefficient multiplier 35 multiplies the output signal Y'(i−n) of the delay element 33A by the negative coefficient α (where 0>α>−1), thus outputting its multiplication result Y'(i−n)×α to the adder 31.

In the standing wave attenuation device 10A, the coefficient multiplier 99 multiplies the output signal Y(i) of the delay element 41 of the feedback comb filter 30A by the positive coefficient β (where 0<β<1), thus outputting its multiplication result Y(i)×β to the D/A converter 69.

Figure 3:
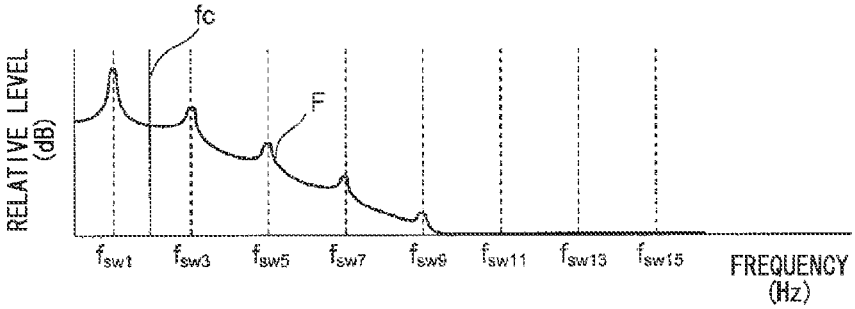
FIG. 3 shows amplitude characteristics F appearing in a part of the standing wave attenuation device of FIG. 1 ranging from an input terminal of an adder to an output terminal of an LPF.

In the standing wave attenuation device 10A of the second embodiment, amplitude characteristics appearing in the circuitry between the input terminal of the adder 31 and the output terminal of the delay element 41 are identical to amplitude characteristics F (see FIG. 3) appearing in the circuitry between the input terminal of the adder 31 and the output terminal of the LPF 42 in the standing wave attenuation device 10 of the first embodiment. This indicates that the third embodiment provides a simpler circuit configuration than the first embodiment, thus downsizing each unit. Additionally, the third embodiment is able to reduce the standing wave $SW_k$ without causing howling and without causing a negative impact on audio quality in the cabin 93.

4. Fourth Embodiment

Figure 8:
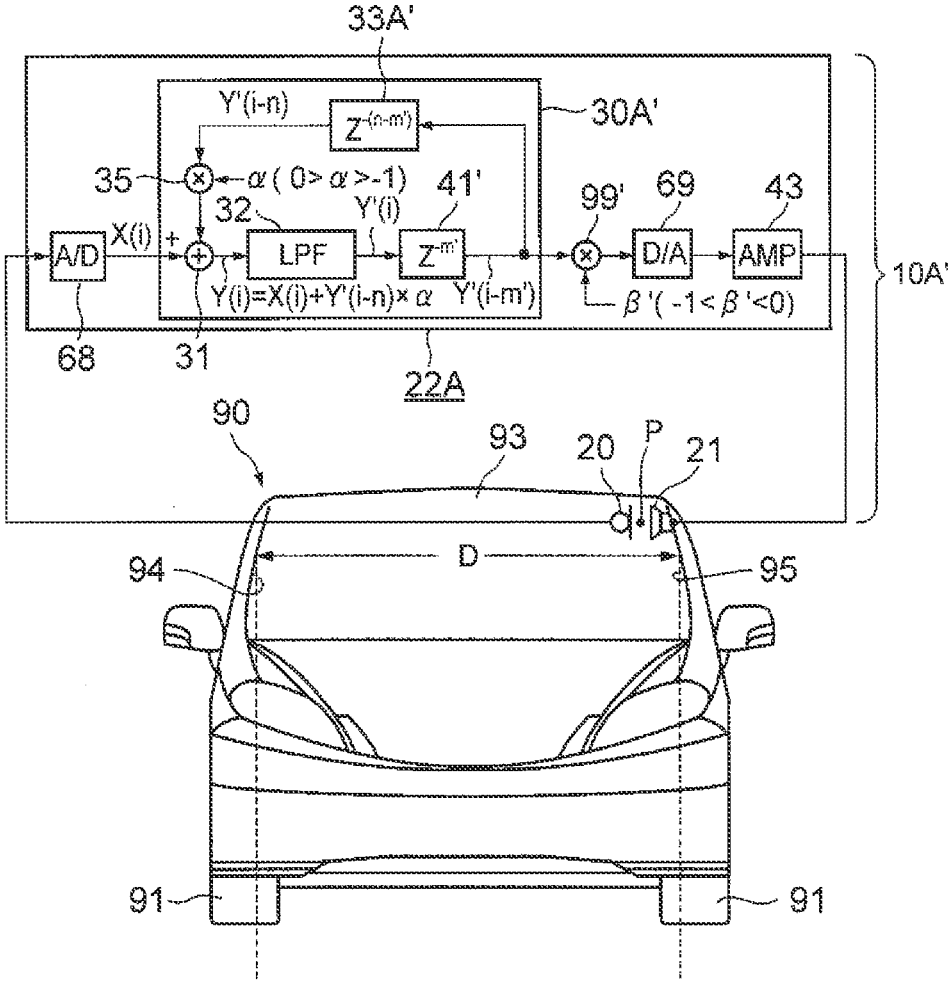
FIG. 8 shows the constitution of a standing wave attenuation device installed in the vehicle according to a fourth embodiment.

FIG. 8 shows the constitution of a standing wave attenuation device 10A' installed in the vehicle 90 according to a fourth embodiment. In the standing wave attenuation device 10A', the delay element 41' and the coefficient multiplier 99' serving as a phase adjustment part are incorporated into the closed loop $LP_{OUT}$ whilst a delay element 33A', the delay element 41', and the coefficient multiplier 35 serving as another phase adjustment part are incorporated into the closed loop $LP_{IN}$. Similar to the standing wave attenuation device 10A of the third embodiment, the standing wave attenuation device 10A' of the fourth embodiment is designed such that the delay element 41' of the feedback comb filter 30A' plays a role as a common factor between two phase adjustment parts.

Specifically, in the standing wave attenuation device 10A', the adder 31 of the feedback comb filter 30A' adds the sound signal X(i) from the A/D converter 68 and the output signal Y'(i−n)×α of the coefficient multiplier 35 so as to output its addition result Y(i)=X(i)+Y'(i−n)×α to the LPF 32. The LPF 32 dampens frequency components above the cutoff frequency fc within the output signal Y(i) of the adder 31, thus outputting the signal Y'(i) to the delay element 41'. The delay element 41' delays the output signal Y'(i) of the LPF 32 by m' samples (i.e. the delay time $DT_{41'}$), thus outputting an m'-sample delayed signal Y'(i−m'), which may contain frequency components of the standing wave $SW_k$ in the sound signal X(i)), to the coefficient multiplier 99' and the delay element 33A' of the feedback comb filter 30A'.

The delay element 33A' delays the output signal Y'(i−m') of the delay element 41' by (n−m') samples, thus outputting the signal Y'(i−n) to the coefficient multiplier 35. Herein, the delay element 33A' possesses a delay time $DT_{33A'}$ corresponding to a difference between the delay time $DT_{41'}$, of the delay element 41' and an odd-numbered multiple of the half period $T_1/2$ of the standing wave $SW_1$. The number (n−m') of samples is produced by dividing the delay time $DT_{33A'}$ of the delay element 33A' by the sampling period Ts of the sound signal X(i). The coefficient multiplier 35 multiplies the output signal Y'(i−n) of the delay element 33A' by the negative coefficient α (where 0>α>−1), thus outputting its multiplication result Y'(i−n)×α to the adder 31.

In the standing wave attenuation device 10A', the coefficient multiplier 99' multiplies the output signal Y'(i−m') by the negative coefficient β' (where −1<β'<0), inverting the phase of the signal Y'(i−m'), thus outputting a phase-inverted signal Y'(i−m')×β' to the D/A converter 69. The fourth embodiment is able to demonstrate the same effect as the third embodiment.

5. Fifth Embodiment

Figure 9:
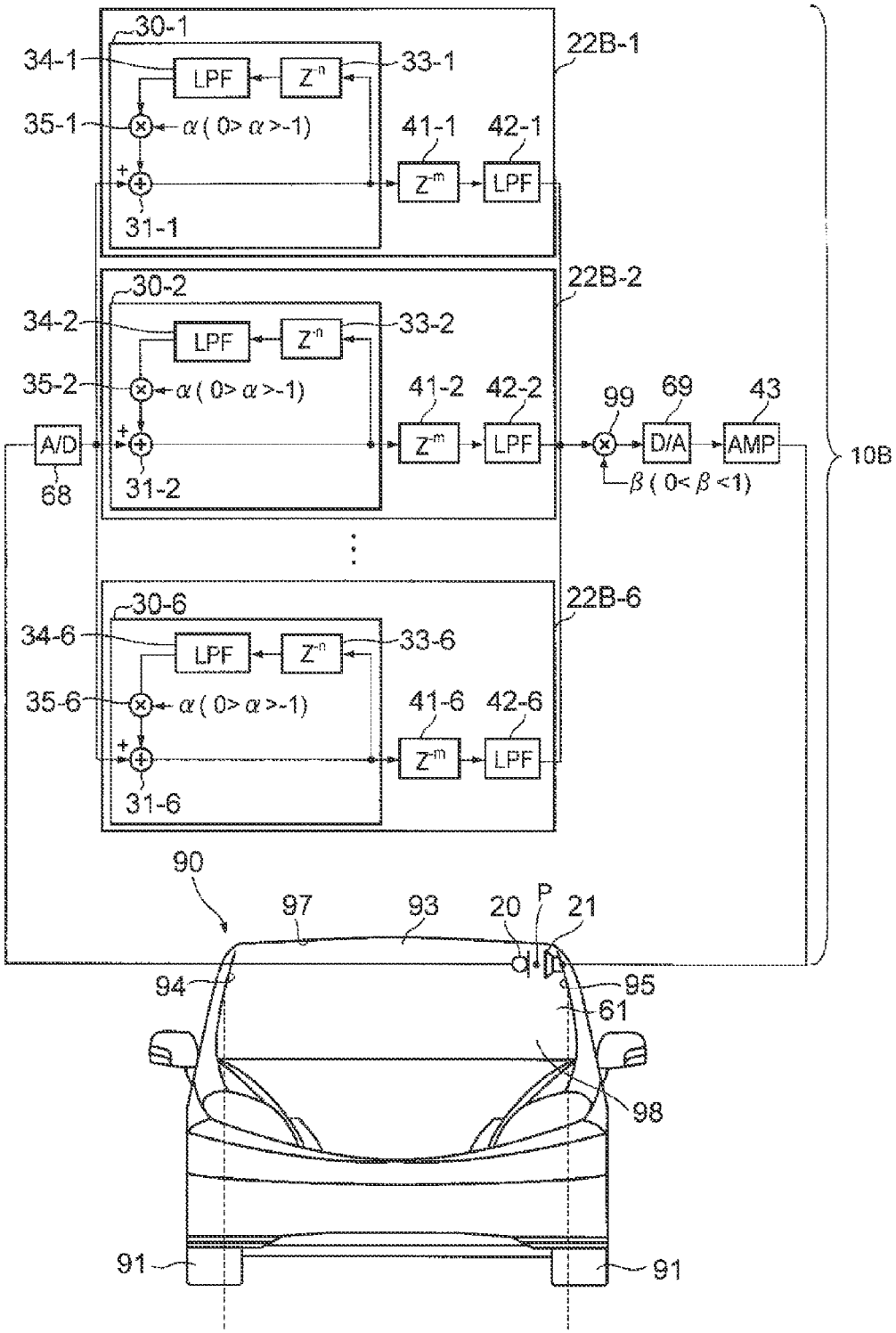
FIG. 9 shows the constitution of a standing wave attenuation device installed in the vehicle according to a fifth embodiment.

FIG. 9 sows the constitution of a standing wave attenuation device 10B installed in the vehicle 90 according to a fifth embodiment. In the standing wave attenuation device 10B, six controllers 22B−u (where u=1 to 6) are interposed in parallel between the A/D converter 68 and the D/A converter 69. Each control 22B−u includes a feedback comb filter 30-*u*, a delay element 41-*u*, and an LPF 42-*u* which are connected in series.

Figure 10A:
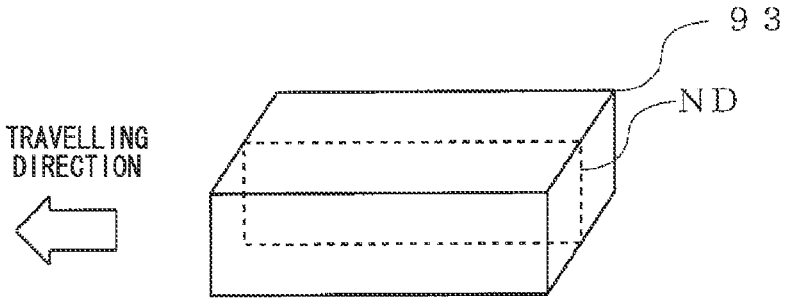
FIG. 10A shows a left-right standing wave with a node disposed at the center between left and right doors in a cabin.
Figure 10B:
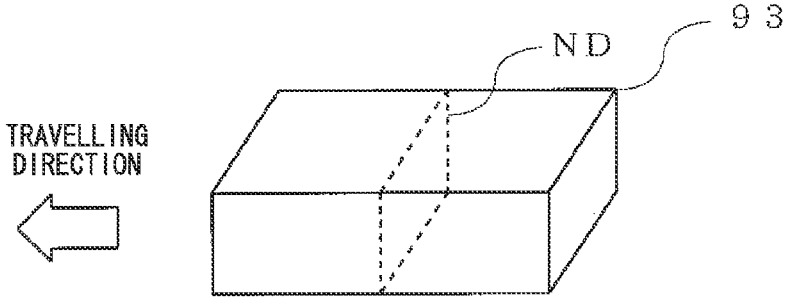
FIG. 10B shows a front-back standing wave with a node disposed at the center between front and rear glasses in a cabin.
Figure 10C:
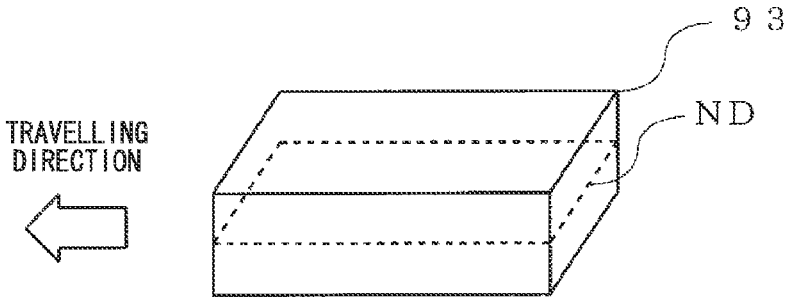
FIG. 10C shows an upper-lower standing wave with a node disposed at the center between a ceiling and a floor in a cabin.

The controller 22B-1 reduces a standing wave $SW_{k1}$, composed of sound waves PW reciprocating between the doors 94 and 95 in the cabin 93, with an axial wave (see FIG. 10A) locating its node ND at the center between the nodes 94 and 95. The controller 22B-2 reduces a standing wave $SW_{k2}$, composed of sound waves PW reciprocating between a front glass 98 and a rear glass (not shown) in the cabin 93, with an axial wave (see FIG. 10B) locating its node at the center between the front glass 98 and the rear glass. The controller 22B-3 reduces a standing wave $SW_{k3}$, composed of sound waves PW reciprocating between a ceiling 97 and a floor (not shown), with an axial wave (see FIG. 10C) locating its node ND at the center between the ceiling 97 and the floor. Additionally, the other controllers 22B-4, 22B-5, 22B-6 reduce standing waves $SW_{k4}$, $SW_{k5}$, $SW_{k6}$, composed of sound waves PW slantingly incident on three-dimensional faces of the cabin 93, respectively. The numbers m, n of delay samples, which are determined based on a wavelength $\lambda_u$ of a standing wave $SW_u$ to be reduced by the controller 22B−u, are respectively set to the delay element 41-*u* and the delay element 33-*u* of the feedback comb filter 30-*u* in the controller 22B−u.

The fifth embodiment is able to reduce the left-right standing wave $SW_{k5}$, the front-back standing wave $SW_{k2}$, the upper-lower standing wave $SW_{k3}$, and slanting standing waves $SW_{k4}$, $SW_{k5}$, $SW_{k6}$, where k=1, 2, . . . . By increasing the number of controllers 22B−u, it is possible to reduce composite standing waves composed of different directional standing waves $SW_{ku}$ (where k=1, 2, . . . ).

6. Variations

The present invention is described in conjunction with the first to fifth embodiments, which are illustrative and not restrictive; hence, it is possible to provide other embodiments and variations as follows.

(1) The first to fifth embodiments are designed such that the microphone 20 and the speaker 21 are attached to the upper portion of the door 95 close to another front passenger's seat (which is opposite to the driver's seat) in the cabin 93 of the vehicle 90. Of course, it is possible to attach the microphone 20 and the speaker 21 to the upper portion of the door 94 close to the driver's seat. Alternatively, it is possible to arrange the microphone 20 and the speaker 21 at another position, such as an assist grip close to the driver's seat, a headrest, A, B, C pillars, an underfoot portion of another front passenger's seat, a door rim, the lower portion of each seat, a heal kick, or the like.

(2) In the first and second embodiments, the LPF 34 is interposed between the delay element 33 and the coefficient multiplier 35 in the closed loop $LP_{IN}$ whilst the LPF 42 is interposed between the delay element 41 and the coefficient multiplier 99 in the closed loop $LP_{OUT}$. In the third and fourth embodiments, the LPF 32 is interposed between the adder 31 and the delay element 41 in the closed loop $LP_{IN}$. However, it is possible to interpose an LPF at another position of the closed loop $LP_{IN}$ (e.g. a position between the adder 31 and the delay element 33, or a position between the coefficient multiplier 35 and the adder 31). It is possible to interpose an LPF at another position of the closed loop $LP_{OUT}$ (e.g. a position between the A/D converter 68 and the feedback comb filter 30, a position between the feedback comb filter 30 and the delay element 41, a position between the delay element 41 and the coefficient multiplier 99, or a position between the coefficient multiplier 99 and the D/A converter 69).

It is possible to provide three or more LPFs in the standing wave attenuation device. For instance, it is possible to additionally provide an LPF following the adder 31 in the closed loop $LP_{IN}$ of the feedback comb filter 30 in the first and second embodiments. This constitution provides three LPFs, i.e. a first one following the adder 31, a second one following the delay element 33 in the closed loop $LP_{IN}$, and a third one following the delay element 41. This constitution increases attenuations of frequency components above the cutoff frequency fc in amplitude characteristics F shown in FIG. 3. In the third and fourth embodiments, it is possible to additionally provide an LPF following the delay element 33A (33A') and another LPF following the feedback comb filter 30A (30A'). This constitution provides three LPFs, i.e. a first one following the adder 31, a second one following the delay element 33A (33A'), and a third one following the delay element 41 (41') in the feedback comb filter 30A (30A').

Figure 11:
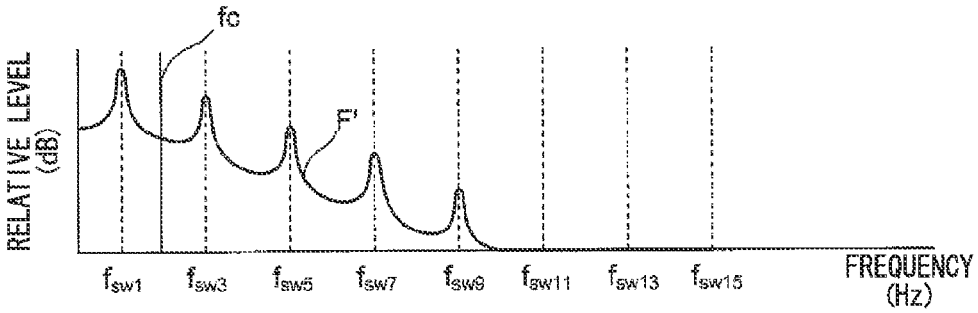
FIG. 11 shows amplitude characteristics F' appearing in a part of the standing wave attenuation device of FIG. 1, precluding an LPF from a feedback comb filter, ranging from the input terminal of the adder to the output terminal of the delay element.

(3) It is possible to modify the first embodiment such that the LPF 34 following the delay element 33 is eliminated whilst the LPF 42 following the feedback comb filter 30 still remains. This constitution demonstrates amplitude characteristics F' (see FIG. 11) in the circuitry between the input terminal of the adder 31 and the output terminal of the delay element 41, in which amplitudes gradually decrease at peak frequencies, above the cutoff frequency fc, while maintaining a certain gain ratio between high pitches and low pitches. This constitution is able to reduce the standing wave SWk without causing howling and without causing a negative impact on audio quality in the cabin 93.

(4) In the first to fifth embodiments, it is possible to additionally provide a frequency adjustment part for adjusting peak frequencies in the transfer function of a feedback comb filter (i.e. the number n of delay samples applied to the delay element 33 of the feedback comb filter 30). Since the standing wave $SW_k$ occurring in the cabin 93 of the vehicle 90 is composed of sound waves PW with the wavelength $\lambda_k$ which is 2/k (where k=1, 2, . . . ) times greater than the distance D between opposite faces in the cabin 93, the frequency $f_{SWk}$ of the standing wave $SW_k$ basically depends on the shape of the cabin 93. When the tires 91 serving as an excitation source of sound emitted in the cabin 93 are replaced with other tires with different dimensions, or when the outside/inside temperature of the cabin 93 varies, however, the frequency $f_{SWk}$ may correspondingly vary in higher/lower frequencies. The foregoing embodiments are able to reduce the standing wave $SW_k$ even when the frequency $f_{SWk}$ varies in the cabin 93.

The foregoing embodiments can be modified to detect the frequency $f_{SWk}$ of the k-degree standing wave $SW_k$ in a predetermined time (e.g. one minute) after running every time the vehicle 90 starts running, thus automatically adjusting the number n of delay samples in the delay part 33 such that a peak frequency of the transfer function of the feedback comb filter 30 matches the frequency $f_{SWk}$. Since the standing wave $SW_k$ occurring in the cabin 93 of the vehicle 90 does not depend on its running speed, the frequency $f_{SWk}$ of the standing wave $SW_k$, just after the vehicle 90 starts running, may not significantly vary during running. Therefore, the foregoing embodiments do not need complex processing such as adaptive control but can capture the frequency $f_{SWk}$ of the standing wave $SW_k$ in the cabin 93, thus efficiently reducing frequency components at $f_{SWk}$.

(5) In the first to fifth embodiments, it is possible to additionally provide an estimation part for estimating the period of the standing wave SWk in the cabin 93 based on the output signal of the microphone 20 serving as an acoustic vibration input device, wherein the delay element 41 (serving as a phase adjustment part) makes a phase adjustment based on the period estimated by the estimation part. This modification can be implemented using the first and second embodiments as follows.

Figure 12:
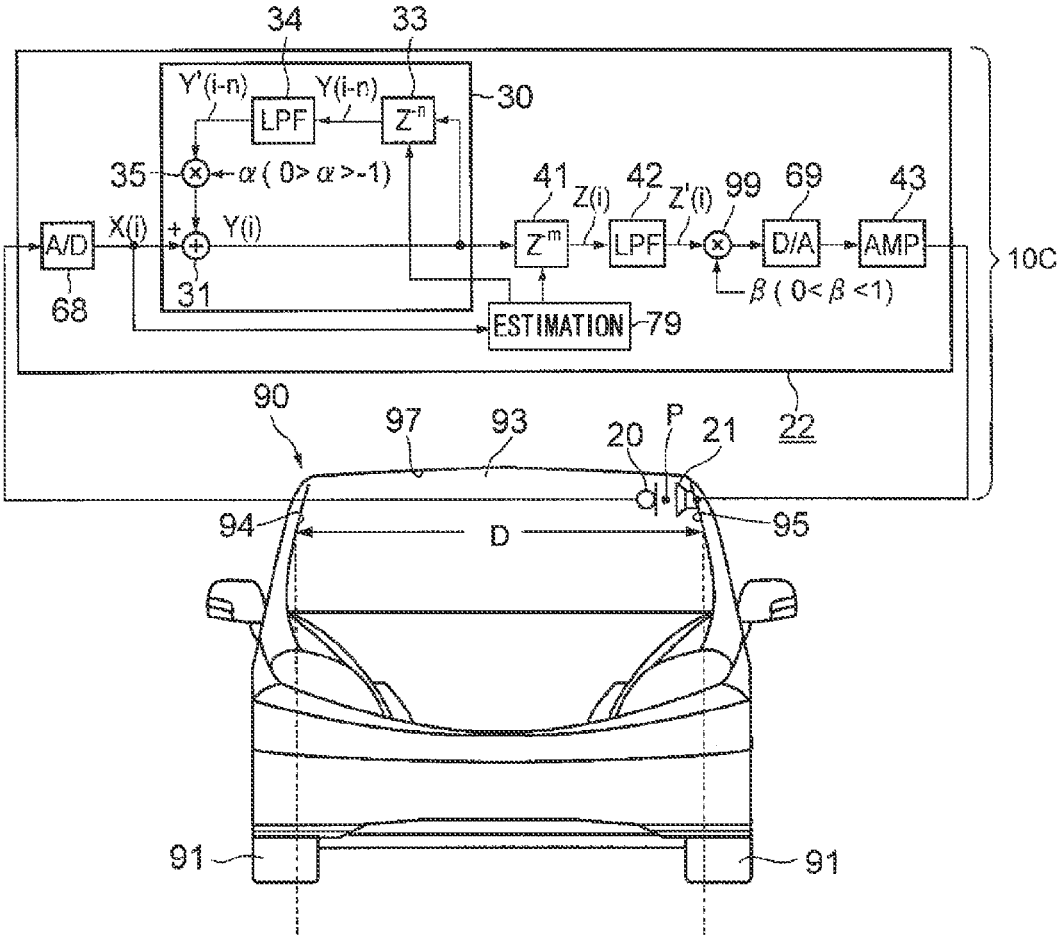
FIG. 12 shows the constitution of a standing wave attenuation device installed in a vehicle according to a first variation of the present invention.

FIG. 12 shows the constitution of a standing wave attenuation device 10C installed in the vehicle 90 according to a first variation of the present invention. The standing wave attenuation device 10C includes an estimation part 79 which performs a series of processing. That is, the estimation part 79 performs FFT (Fast Fourier Transform) on the sound signal X(i) collected by the microphone 20 in the cabin 93, thus detecting a predominant frequency in power spectrum, which is obtained by FFT, as a frequency $f_1$ of a first-order standing wave $SW_1$ in the cabin 93. Then, the estimation part 79 divides one second by the frequency $f_1$ to produce an estimation value $T_1'$ of the period of the standing wave $SW_1$ in the cabin 93, wherein the estimation part 79 sends a signal representing this estimated value $T_1'$ to the delay elements 33 and 41. Upon receiving the signal representing the estimated value $T_1'$ from the estimation part 79, the delay element 41 determines its optimum delay time $DT_{OPT41}$ corresponding to a difference between a half time $T_1'/2$ (i.e. a half period of the standing wave $SW_1$) and the total of transmission delays in the closed loop $LP_{OUT}$, thus updating the number m of delay samples to match a value which is produced by dividing the optimum delay time $DT_{OPT41}$ by the sampling period Ts. On the other hand, the delay element 33 determines its optimum delay time $DT_{OPT33}$ corresponding to the half time $T_1'/2$, thus updating the number n of delay samples to match a value which is produced by dividing the optimum delay time $DT_{OPT33}$ by the sampling period Ts.

Figure 13:
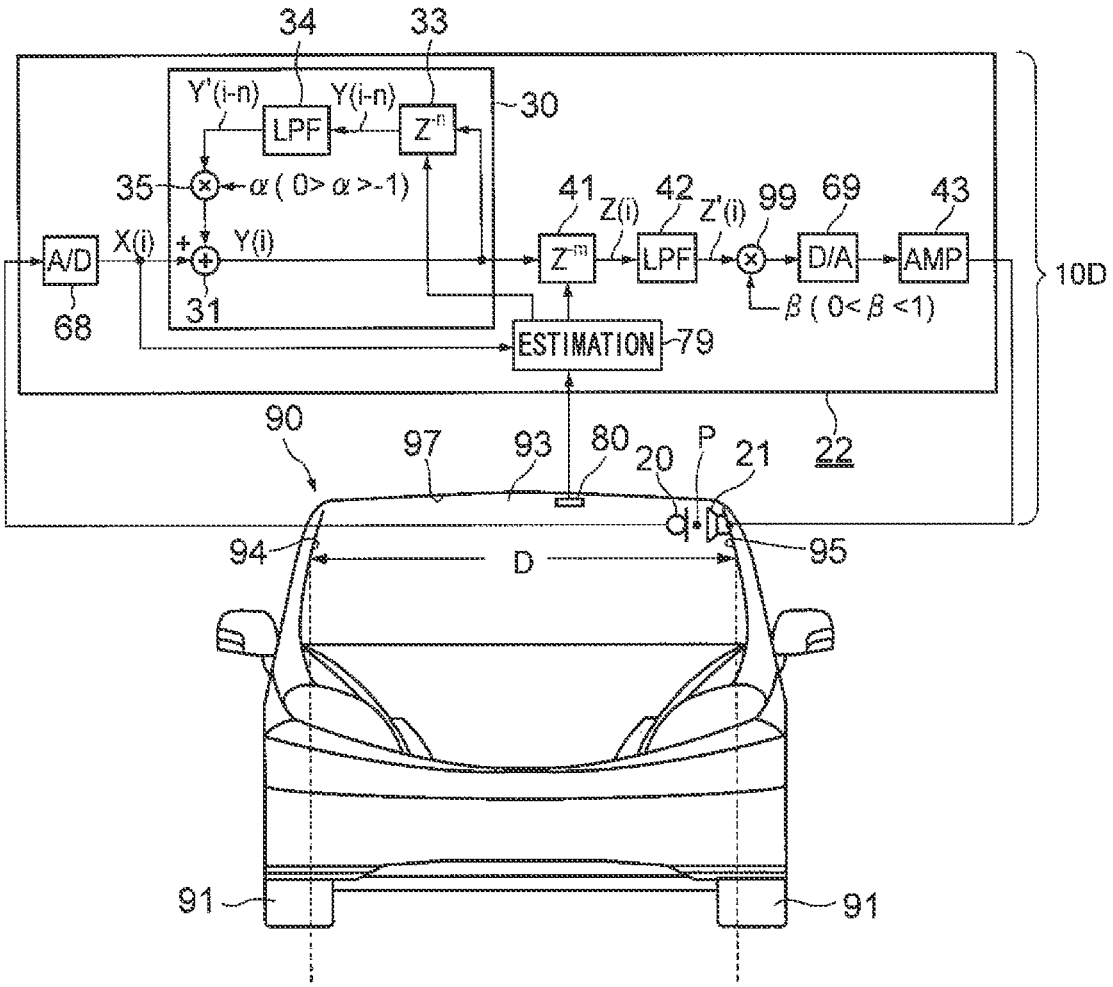
FIG. 13 shows the constitution of a standing wave attenuation device installed in a vehicle according to a second variation of the present invention.

FIG. 13 shows the constitution of a standing wave attenuation device 10D installed in the vehicle 90 according to a second variation of the present invention. The standing wave attenuation device 10D provides a thermometer 80 in addition to the estimation part 79. The thermometer 80 is installed inside the cabin 93. The estimation part 79 performs a series of processing. That is, the estimation part 79 calculates a sound propagation speed C at a measuring point in the cabin 93 based on a temperature measured by the thermometer 80. The estimation part 79 determines the wavelength $\lambda_1$ of the first-degree standing wave SW1 as two times the distance D between doors in the cabin 93. Additionally, the estimation part 79 calculates an estimated value $T_1'$ of the period of the standing wave $SW_1$ by dividing the wavelength $\lambda_1$ by the sound propagation speed C, thus sending a signal representing the estimated value $T_1'$ to the delay elements 33 and 41. Upon receiving the signal representing the estimated value $T_1'$ from the estimation part 79, the delay element 41 determines its optimum delay time $DT_{OPT41}$ corresponding to a difference between a half time $T_1'$ (i.e. a half period of the standing wave SW1) and the total of transmission delays in the closed loop $LP_{OUT}$, thus updating the number m of delay samples to match a value which is produced by dividing the optimum delay time $DT_{OPT41}$ by the sampling period Ts. On the other hand, the delay element 33 determines its optimum delay time $DT_{OPT33}$ corresponding to the half time $T_1'/2$, thus updating the number n of delay samples to match a value which is produced by dividing the optimum delay time $DT_{OPT33}$ by the sampling period Ts.

(6) The delay element 41 employed in the first, third, and fifth embodiments adjusts the phase of the output signal Y(i) of the feedback comb filter 30 such that the time needed for one-time circulation of a signal through the closed loop $LP_{OUT}$ matches the half period $T_k/2$ of the standing wave $SW_k$ in the cabin 93. Alternatively, it is possible to adjust the phase of the output signal Y(i) of the feedback comb filter 30 such that the time needed for one-time circulation of a signal through the closed loop LPOUT matches an odd-numbered multiple of the half period of the standing wave $SW_k$ in the cabin 93 (e.g. a triple of the half period of the standing wave $SW_k$; $3T_k/2$, or a quintuple of the half period of the standing wave $SW_k$; $5T_k/2$).

(7) In the second and fourth embodiments, the delay element 41 adjusts the phase of the output signal Y(i) of the feedback comb filter 30 such that a time needed for one-time circulation of a signal through the closed loop LPOUT matches the period $T_k$ of the standing wave $SW_k$ in the cabin 93, so that the phase-adjusted signal Y(i) is inverted in phase and then supplied to the speaker 21. Alternatively, it is possible to adjust the phase of the output signal Y(i) of the feedback comb filter 30 such that the time needed for one-time circulation of a signal through the closed loop $LP_{OUT}$ matches an integral multiple of the period of the standing wave $SW_k$ (e.g. a double of the period of the standing wave $SW_k$; $2T_k$, or a triple of the period of the standing wave $SW_k$; $3T_k$) in the cabin 93, so that the phase-adjusted signal Y(i) is inverted in phase and then supplied to the speaker 21.

(8) The first to third embodiments refer to an application of the present invention which aims to reduce the standing wave $SW_k$ in the cabin 93 of the vehicle 90; but the present invention can be utilized for another application. For instance, the standing wave attenuation device of the present invention can be utilized as a replacement of a porous material for absorbing unwanted resonance in a speaker enclosure. In this application, the microphone 20 and the speaker 21 are arranged at a position corresponding to an antinode of a k-degree standing wave $SW_k$ depending upon dimensions of a speaker enclosure. The standing wave attenuation device 10 produces the output sound signal Z'(i) based on the input sound signal X(i) collected by the microphone 20, so that the speaker 21 produces the sound wave CW for reducing the standing wave $SW_k$ based on the output sound signal Z'(i). This application may effectively work in suppressing the standing wave $SW_k$ in a limited space surrounded by at least a pair of walls, such as transporters, vehicles, ships, airplanes, railway vehicles, space stations, conference rooms, soundproof rooms, karaoke boxes, baths with acoustics, speaker boxes, electronic pianos, personal computers, housings of home-use appliances, spaces facing roofs of furniture or floors under furniture, corridors facing walls and floors.

The present invention can be utilized as a technical measure for preventing unwanted vibration, such as rattling in the housing of an electronic keyboard instrument. In this case, the microphone 20 and the speaker 21 are arranged at a position corresponding to an antinode of a k-degree standing wave $SW_k$ depending upon dimensions of the housing of an electronic keyboard instrument. The standing wave attenuation device 10 produces the output sound signal Z'(i) based on the input sound signal X(i) collected by the microphone 20, so that the speaker 21 emits the sound wave CW based on the output sound signal Z'(i).

The present invention can be utilized as a technical measure for preventing abnormal sound occurring in an acoustic guitar. When an acoustic guitar produces a specific-frequency sound when a string is plucked, a k-degree standing wave $SW_k$ may occur inside the guitar body in response to the specific-frequency sound, thus causing abnormal sound known as a wolf tone. To reduce the standing wave $SW_k$ causing abnormal sound, the microphone 20 and the speaker 21 are arranged at a position corresponding to an antinode of the standing wave SWk depending on dimensions of the inside space of a body of a guitar. The standing wave attenuation device 10 produces the output sound signal Z'(i) based on the input sound signal X(i) collected by the microphone 20, so that the speaker 21 emits the sound wave CW based on the output sound signal Z'(i).

(9) In the first to fifth embodiments, the LPFs 32, 34, 42 (each serving as a frequency characteristics adjustment part) can be replaced with another type of filter with a band allowing the standing wave $SW_k$ to pass therethrough, such as a high-pass filter (HPS), a band-pass filter (BPF), a low-shelving filter, a high-shelving filter, a peaking filter, a dipping filter, and combinations of these filters, and further combinations of these filters combined with LPF.

(10) In the first, second, and fifth embodiments, the coefficient multiplier 99 is interposed between the LPF 42 and the D/A converter 69. In the third and fourth embodiments, the coefficient multiplier 99 is interposed between the feedback comb filter 30A and the D/A converter 69. It is possible to interpose the coefficient multiplier 99 at another position (e.g. a position between the A/D converter 68 and the feedback comb filter 30, a position between the feedback comb filter 30 and the delay element 41, or a position between the delay element 41 and the LPF 42 in the standing wave attenuation device 10, 10'; a position between the A/D converter 68 and the feedback comb filter 30 in the standing wave attenuation device 10A, 10A').

(11) In the first, second, and fifth embodiments, the feedback comb filter 30, the delay element 41, the LPF 42, and the coefficient multiplier 99 are sequentially aligned between the A/D converter 68 and the D/A converter 69. It is possible to change the alignment order of these constituent elements in various ways, such as a first alignment consisting of the feedback comb filter 30, the delay element 41, the coefficient multiplier 99, and the LPF 42, a second alignment consisting of the feedback comb filter 30, the LPF 42, the coefficient multiplier 99, and the delay element 41, a third alignment consisting of the feedback comb filter 30, the LPF 42, the delay element 41, and the coefficient multiplier 99, a fourth alignment consisting of the feedback comb filter 30, the coefficient multiplier 99, the LPF 42, and the delay element 41, and a fifth alignment consisting of the feedback comb filter 30, the coefficient multiplier 99, the delay element 41, and the LPF 42. Alternatively, it is possible to provide the delay element 41, the LPF 42, and the coefficient multiplier 99 before the feedback comb filter 30.

(12) In the third and fourth embodiments, the feedback comb filter 30A and the coefficient multiplier 99 are aligned between the A/D converter 68 and the D/A converter 69. Alternatively, it is possible to provide the coefficient multiplier 99 before the feedback comb filter 30A.

(13) The first to fifth embodiments can be modified to further provide a delay measurement part for measuring the total of transmission delays in the closed loop $LP_{OUT}$. This constitution can be implemented such that the delay measurement part provides a pulse signal to an arbitrary measurement point (e.g. a measurement point between the power amplifier 43 and the speaker 21). The pulse signal applied to the measurement point is transmitted through the speaker 21, the microphone 20, the A/D converter 68, the feedback comb filter 30, . . . , the D/A converter 69, and the power amplifier 43 and then fed back to the measurement point. The delay measurement part determines the total of transmission delays occurring in the closed loop $LP_{OUT}$ in correspondence with an interval of time between the timing of applying a time-variant sound (e.g. a pulse tone or a tone burst) to the measurement point and the timing of feeding it back to the measurement point, thus supplying a signal representing the total of transmission delays to the delay element 41. The delay element 41 adjusts the number m of delay samples based on the total of transmission delays. This constitution is able to prevent an unwanted situation in which the standing wave $SW_k$ cannot be sufficiently suppressed since the sound wave CW may fluctuate in phase to be more advanced or delayed than the target phase.

Lastly, the present invention is not necessarily limited to the foregoing embodiments and variations; hence, the present invention should embrace other modifications and alternative measures that fall within the scope of the invention as defined in the appended claims.

What is claimed is:

1. A standing wave attenuation device comprising:

a first closed loop including an acoustic vibration input device which converts sound, including a standing wave component occurring in a compartment of a vehicle wherein there are fluctuations in vibration directions and frequencies, into a sound signal, a feedback comb filter which processes the sound signal to pass the standing wave component therethrough, and an acoustic vibration output device which provides an output signal based on the processing result of the feedback comb filter;

a first phase adjustment part, involved in the first closed loop, which adjusts a phase difference, between an input phase of the standing wave component input to the acoustic vibration input device and an output phase of the standing wave component output from the acoustic vibration output device, to match an odd-numbered multiple of a prescribed value relating to a period of the standing wave component;

a second closed loop involving the feedback comb filter with an adder which introduces the output signal of the acoustic vibration input device into the second closed loop; and a second phase adjustment part, involved in the second closed loop, which adjusts a phase difference, between a phase of the standing wave component input to the adder via the acoustic vibration input device and a phase of the standing wave component fed back to the adder via the second closed loop, to match an odd-numbered multiple of the prescribed value, wherein the second phase adjustment part, involved in the second closed loop, includes a first delay element with a first delay time corresponding to a difference between the total of transmission delays in the second closed loop and an odd-numbered multiple of a half period of the standing wave component, a second delay element with a second delay time corresponding to a difference between the first delay time of the first delay element and the odd-numbered multiple of the half period of the standing wave component, and a coefficient multiplier for performing phase inversion, and wherein the first phase adjustment part, involved in the first closed loop, includes a delay element with a delay time corresponding to a difference between the total of transmission delays in the first closed loop and the odd-numbered multiple of the half period of the standing wave component.

2. The standing wave attenuation device according to claim 1 further comprising an estimation part which estimates a period of the standing wave component appearing in a space between the acoustic vibration input device and the acoustic vibration output device based on the sound signal output from the acoustic vibration input device.

3. A standing wave attenuation device comprising:

a first closed loop including an acoustic vibration input device which converts sound, including a standing wave component occurring in a compartment of a vehicle wherein there are fluctuations in vibration directions and frequencies, into a sound signal, a feedback comb filter which processes the sound signal to pass the standing wave component therethrough, and an acoustic vibration output device which provides an output signal based on the processing result of the feedback comb filter;

a first phase adjustment part, involved in the first closed loop, which adjusts a phase difference, between an input phase of the standing wave component input to the acoustic vibration input device and an output phase of the standing wave component output from the acoustic vibration output device, to match an odd-numbered multiple of a prescribed value relating to a period of the standing wave component;

a second closed loop involving the feedback comb filter with an adder which introduces the output signal of the acoustic vibration input device into the second closed loop; and a second phase adjustment part, involved in the second closed loop, which adjusts a phase difference, between a phase of the standing wave component input to the adder via the acoustic vibration input device and a phase of the standing wave component fed back to the adder via the second closed loop, to match an odd-numbered multiple of the prescribed value, wherein the second phase adjustment part, involved in the second closed loop, includes a first delay element with a first delay time corresponding to a difference between the total of transmission delays in the second closed loop and an integral multiple of the period of the standing wave component, a second delay element with a second delay time corresponding to a difference between the first delay time of the first delay element and an odd-numbered multiple of the half period of the standing wave component, and a coefficient multiplier for performing phase inversion, and wherein the first phase adjustment part, involved in the first closed loop, includes a delay element with a delay time corresponding to a difference between the total of transmission delays in the first closed loop and the integral multiple of the period of the standing wave component, and a coefficient multiplier for performing phase inversion.

4. The standing wave attenuation device according to claim 3 further comprising an estimation part which estimates a period of the standing wave component appearing in a space between the acoustic vibration input device and the acoustic vibration output device based on the sound signal output from the acoustic vibration input device.

* * * * *